US010358150B2

(12) United States Patent
Carter et al.

(10) Patent No.: US 10,358,150 B2
(45) Date of Patent: Jul. 23, 2019

(54) RAIL CLAMP

(71) Applicant: HARSCO CORPORATION, Camp Hill, PA (US)

(72) Inventors: Eric Carter, Camp Hill, PA (US); Lee Bolton, Camp Hill, PA (US)

(73) Assignee: HARSCO CORPORATION, Camp Hill, PA (US)

( * ) Notice: Subject to any disclaimer, the term of this patent is extended or adjusted under 35 U.S.C. 154(b) by 1096 days.

(21) Appl. No.: 14/213,886

(22) Filed: Mar. 14, 2014

(65) Prior Publication Data

US 2014/0261048 A1 Sep. 18, 2014

Related U.S. Application Data

(60) Provisional application No. 61/794,062, filed on Mar. 15, 2013.

(51) Int. Cl.

| | |
|---|---|
| ***B61D 15/00*** | (2006.01) |
| ***E01B 29/04*** | (2006.01) |
| ***E01B 27/16*** | (2006.01) |
| *E01B 27/17* | (2006.01) |

(52) U.S. Cl.

CPC ..... *B61D 15/00* (2013.01); *E01B 27/16* (2013.01); *E01B 29/04* (2013.01); *E01B 27/17* (2013.01)

(58) Field of Classification Search

CPC ..... E01B 31/02; E01B 29/04; E01B 29/24; E01B 29/32; E01B 29/42; E01B 31/12; E01B 37/00; E01B 2203/10

USPC ..... 104/12, 7.1

See application file for complete search history.

(56) References Cited

U.S. PATENT DOCUMENTS

| | | | | |
|---|---|---|---|---|
| 4,744,302 | A * | 5/1988 | Theurer | E01B 31/08 104/7.1 |
| 5,299,505 | A * | 4/1994 | Theurer | E01B 27/17 104/7.1 |
| 6,705,232 | B2 * | 3/2004 | Theurer | E01B 27/17 104/12 |
| 8,245,646 | B1 | 8/2012 | Miller et al. | |
| 2003/0196565 | A1 | 10/2003 | Decker et al. | |
| 2011/0209549 | A1 | 9/2011 | Kahn | |
| 2012/0097802 | A1 | 4/2012 | Pease | |

FOREIGN PATENT DOCUMENTS

| | | | |
|---|---|---|---|
| JP | 2-101204 | * | 4/1990 |
| JP | 2006-250573 A | | 9/2006 |

OTHER PUBLICATIONS

International Search Report and Written Opinion, PCT/US2014/029273, dated Jul. 30, 2014, 7 pages.

(Continued)

*Primary Examiner* — Mark T Le

(74) *Attorney, Agent, or Firm* — Baker & McKenzie LLP

(57) ABSTRACT

A rail vehicle includes a frame, a pair of wheels, a joint locator, a clamping assembly, and a processor. The wheels travel along a rail. The joint locator detects a joint bar on the rail. The clamping assembly is coupled to the frame and includes a pair of rail clamps disposed laterally outward of the pair of wheels. The processor is configured to automatically actuate the clamping assembly when the clamping assembly reaches the joint bar.

16 Claims, 9 Drawing Sheets

(56) References Cited

OTHER PUBLICATIONS

Extended European search report from co-pending European application No. EP14765701.9 filed Mar. 14, 2014, EP publication No. EP2971356 published Jan. 20, 2016 (Applicant Harsco Technologies LLC).
Indian Examination Report issued by the Intellectual Property of India dated Apr. 30, 2019 in connection with Indian patent application No. 2747/MUMNP/2015.

* cited by examiner

RAIL CLAMP

CROSS-REFERENCE TO RELATED APPLICATIONS

This application claims priority to U.S. Provisional App. Ser. No. 61/794,062, filed Mar. 15, 2013, which is hereby incorporated by reference in its entirety.

BACKGROUND

The present application relates generally to a rail vehicle for performing maintenance operations, and more particularly to a tamper vehicle having a rail clamp for use in lifting, aligning, cross leveling and/or applying geometric corrections (generally referred to as "surfacing and lining" operations) to railroad tracks.

Generally, a railroad includes at least one pair of elongated, substantially parallel rails coupled to a plurality of laterally extending ties, which are disposed on a ballast bed. The rails may be constructed from a plurality of rail pieces joined by joint bars to form the rails in the track direction. The rails are coupled to the ties by tie plates and spikes and/or spring clip fasteners, which is an example of a class of fasteners that may be referred to as anchors. The ballast is generally hard particulate material such as, but not limited to, gravel. The ballast filled space between ties is referred to as a crib. Over time, normal wear and tear on the railroad may cause the rails to deviate from a desired geometric orientation.

Rail maintenance processes for addressing such concerns involve the use of machines such as a tamping machine. These machines may lift the rail to permit the carrying out of geometric corrections to the rail orientation, while also allowing tamping units to tamp the ballast bed adjacent to the tie being worked. However, it has been found that typical clamps for lifting the rail are not suitable for gripping and lifting of the rail at joint bars or other obstacles where the rail deviates from its typical I-beam profile, for example where there is a larger stem width.

BRIEF SUMMARY

In an embodiment, a rail vehicle includes a frame, a pair of wheels, a joint locator, a clamping assembly, and a processor. The wheels travel along a rail. The joint locator detects a joint bar on the rail. The clamping assembly is coupled to the frame and includes a pair of rail clamps disposed laterally outward of the pair of wheels. The processor is configured to automatically actuate the clamping assembly when the clamping assembly reaches the joint bar.

In another embodiment, a method of performing rail maintenance includes: providing a rail vehicle including a pair of wheels that travel along a rail, a joint locator that detects a joint bar on the rail, and a clamping assembly, the clamping assembly including a pair of clamps disposed laterally outward of the pair of wheels; detecting, using the joint locator, the joint bar on the rail; determining, using a processor, when the clamping assembly will reach the joint bar; extending the clamps to below the rail; and lifting the rail with the clamps, wherein the extending and the lifting occur before the clamping assembly reaches the joint bar.

DETAILED DESCRIPTION

Embodiments described herein relate generally to a rail clamp for use with rail vehicles. The rail clamp described herein may be used with any type of rail vehicle that is suitable for lifting track. In one example, the rail clamp is used with a continuous action tamper vehicle. The rail clamp may also be deployed on unmanned, drone rail vehicles. The rail clamp is disposed laterally of the rails and may be actuated to engage a lower portion of the rail in lifting operations. The rail clamp is suitable for lifting of rail in any operation, and particularly when the stem width of the rail is larger than normal, such as at joint bars.

Figure 1:
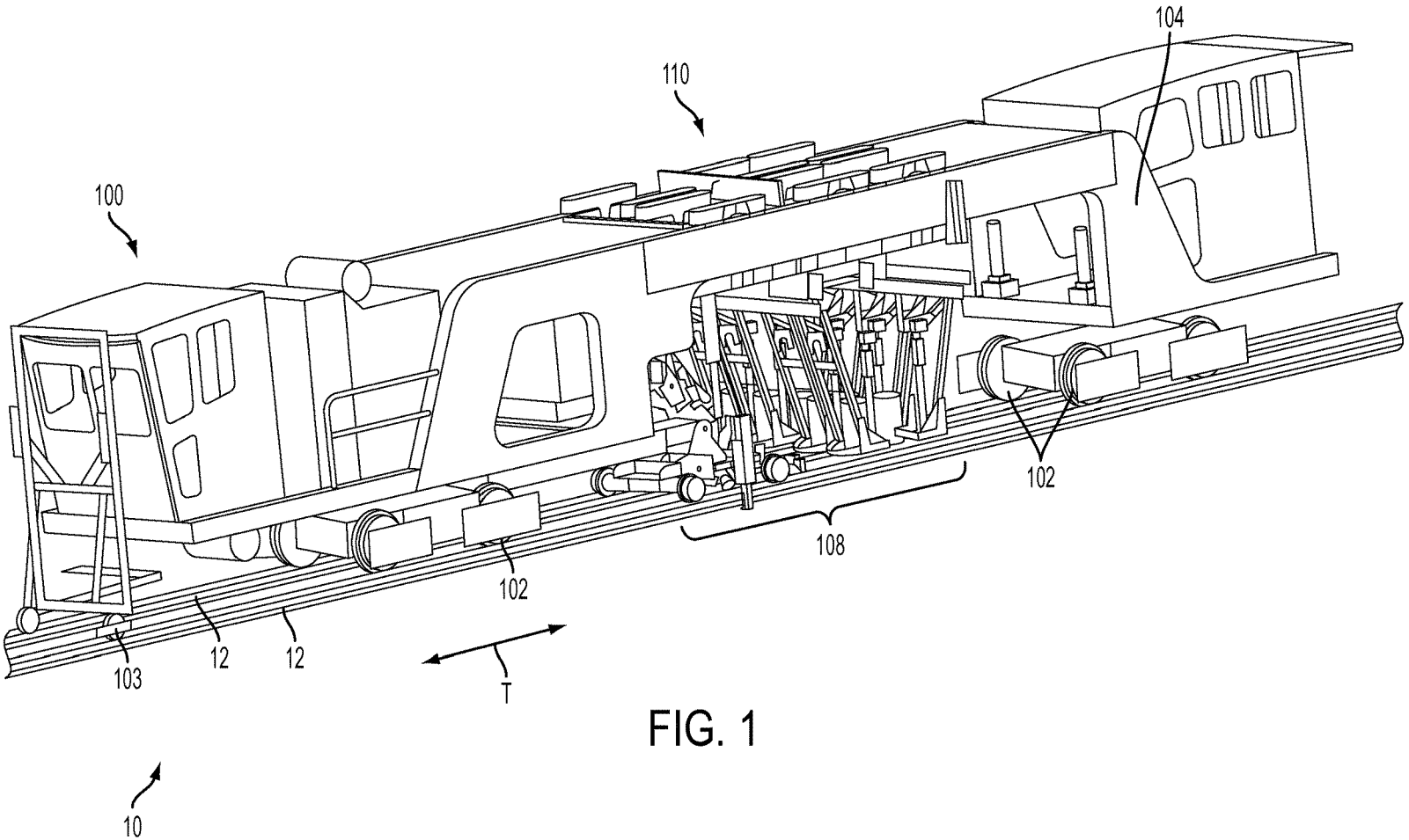
FIG. 1 is a perspective view of an exemplary rail maintenance vehicle.

Referring to FIG. 1, a rail maintenance vehicle 100 may travel on a railroad 10. The rail road 10 may include a pair of rails 12 extending in a track direction T. The rail maintenance vehicle 100 may include a plurality of wheels 102 coupled to a frame 104 by which the rail maintenance vehicle 100 may travel along the rails 12. A joint bar locator 103, which may also provide tie locations (e.g., a tie locator), may be provided at a forward wheel of the rail maintenance vehicle 100. The joint bar 103 may also be provide anywhere forward (with reference to the travelling direction of the rail maintenance vehicle 100) of the work head portion 108. The rail maintenance vehicle 100 may include a motor 106 to provide propulsion or may be towed or pushed by another vehicle.

The work head portion 108 may be coupled to the frame 104 by the sub-frame portion 110. The sub-frame portion 110 may be actuated to reciprocate with respect to the frame 104 by an actuator for continuous work. In this mode, the work head portion 108 may remain substantially stationary for a period of time to perform work at the site of a particular tie while the rail maintenance vehicle 100 is continuously driven forward.

Figure 2:
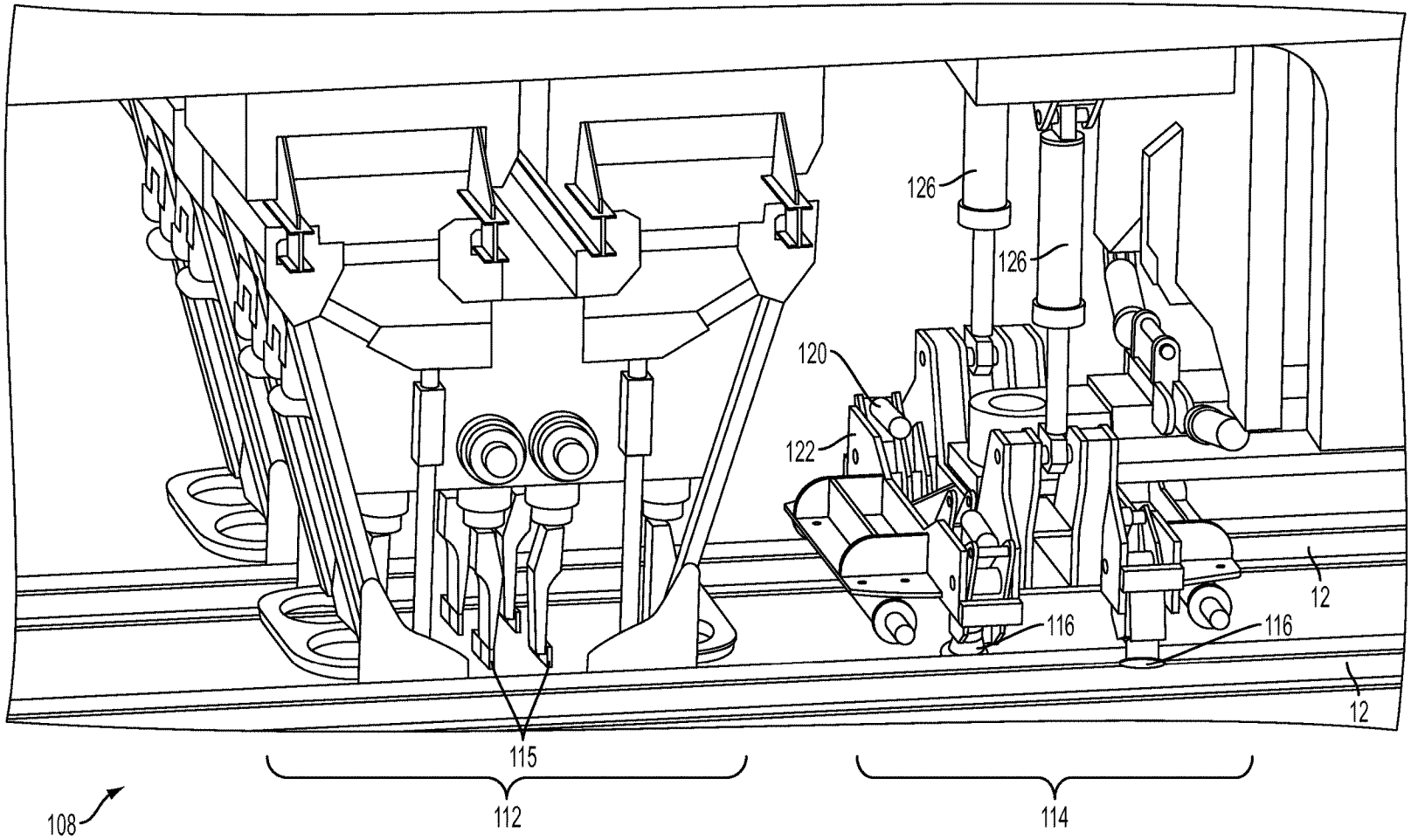
FIG. 2 is a perspective view of an exemplary work head portion of a rail maintenance vehicle.

Referring to FIG. 2, an enlarged view of the work head portion 108 is shown (note that the perspective of FIG. 1 and FIG. 2 is reversed). The work head portion 108 may include work heads 112 and clamp assembly 114. The work heads 112 are shown as a tamper work head assembly including tampers 115 but may also be any type of work head.

Figure 3:
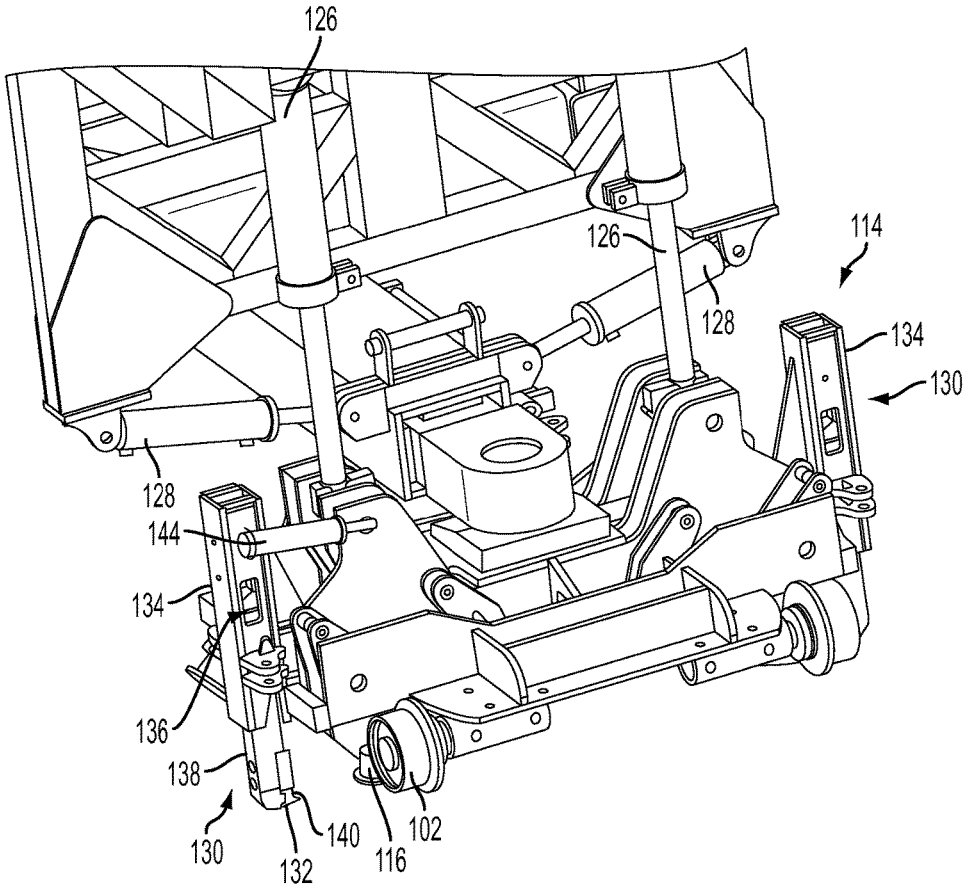
FIG. 3 is a perspective view of an exemplary clamp assembly.
Figure 4:
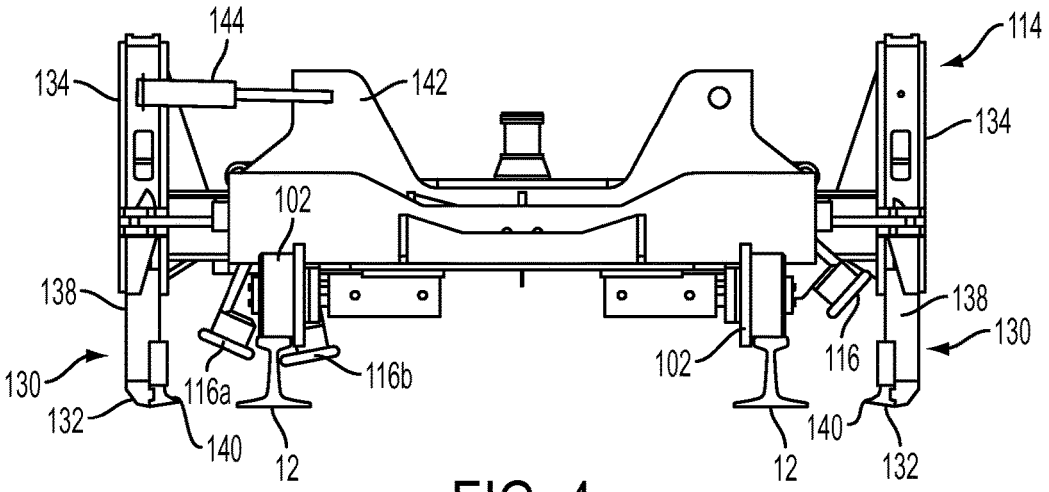
FIG. 4 is a front view of an exemplary clamp assembly.

Referring also to FIGS. 3 and 4, the clamp assembly 114 may include a plurality of roller clamps 116, which are actuated such that they rotate into position to grip and then lift the rail. The roller clamps 116 may be actuated from a stowed position (e.g., see roller clamp 116*a*) into lifting position (e.g., see roller clamp 116*b*) via hydraulic cylinders 120 operatively coupled to the clamp assembly frame 122.

A processor, for example mounted to the frame 104, may be coupled to the motor 106, the work head portion 108 and the clamp assembly 114 to control the operation of the various components of the rail maintenance vehicle 100 and provide, by way of example, the functionality described herein.

Figure 5A:
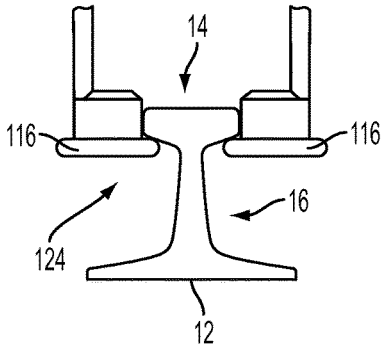
FIG. 5A is a cross-sectional view of an exemplary roller clamp and rail.

With reference to FIG. 5A, the roller clamps are rotated to position a lower flange portion 124 adjacent to the intersection of the top portion 14 of the I-beam profile of the rail 12 and the stem portion 16 of the rail. In this manner, the roller clamps 116 are able to "grip" the rail 12 at an upper portion of the rail. The hydraulic cylinders 126 may then impart an upward force and lift the rails 12. Note that the clamp assembly 114 may also include hydraulic cylinders 128 for raising and lowering the clamp assembly 114 between a stowed position and a working position. The hydraulic cylinders 128 may also impart lifting force to the rails 12 when the rails 12 are engaged by the roller clamps 116.

Figure 5B:
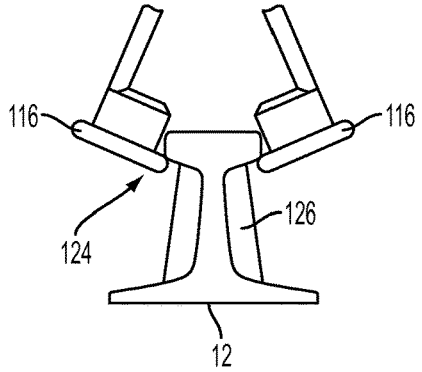
FIG. 5B is a cross-sectional view of an exemplary roller clamp and rail at a joint bar.
Figure 5C:
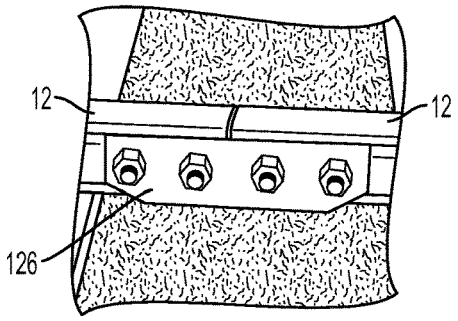
FIG. 5C is a perspective view of an exemplary rail including a joint bar.

With reference to FIG. 5B, there may be obstructions along the rails 12 that impeded or prevent the lower flange portion 124 of the roller clamps 116 from engaging the upper portion of the rail 12. For example, the rail 12 may be provided by a plurality of rail sections joined together by joint bars. FIG. 5C illustrates sections of the rail 12 joined by the join bar 126. Referring back to FIG. 5B, when an obstruction such as a joint bar is encountered, the flange defined by the upper portion of the rail 12 where the top portion 14 meets the stem portion 16 becomes occluded and the flange portion 124 of the roller claims 116 become unable to "grip" underneath the upper portion of the rail 12. This reduces or eliminates the ability of the roller claims 116 to impart a lifting force to the rail 12.

Referring back to FIGS. 3 and 4, the clamp assembly 114 may include an additional pair of clamps 130 (referred to herein as a "transit clamp") disposed on the clamp assembly 114, which may be used to lift the rail 12 when obstacles present difficulties in using only the roller clamps 116 to lift or "jack" rail. In practice, the rail vehicle 10 may include a tie locator (e.g., joint locator 103) located forward of the work head portion 108 for detecting the presence of obstacles, such as a joint bar. In some embodiments, the rail vehicle may include two tie locators with one such tie locator positioned over each rail to allow the tie locators to detect if a tie is skewed, for example. The tie locator may be any device that can locate a tie such as a metal detector that can detect a tie plate, or a photo detector or radar that can identify a tie. The processor may receive a signal from the joint locator 103 indicating the detection of a joint plate. The distance between the joint locator 103 is fixed or deterministic (in the case of a continuous operation vehicle using a reciprocating work head portion, the relative position of the work head portion to the frame can be determined thereby determining the distance between the joint locator 103 and the transit clamp 130 (and/or the roller clamps 116). This enables the processor to engage the transit clamp 130 and, in some embodiments, disengage the roller clamps 116 automatically when the clamp assembly 114 reaches the joint plate. The detection of joint plates and automatic engagement of the transit clamp (and in some embodiments disengagement of the roller clamp assembly), allows for the realization of exemplary benefits such as fewer clamps necessary to traverse joint plates, fewer disruptions to the maintenance work, and less required involvement of an operator.

The transit clamp 130 may include a pair of clamp devices 132 disposed laterally outward of the clamp frame. Each clamp device 132 includes a casing 134, which substantially encloses a hydraulic cylinder 136 coupled to a clamp arm 138. The hydraulic cylinder 136 may provide extension and retraction of the clamp arm 138. The clamp arm 138 may include a reinforced gripping portion 140, such as a carbide portion, which is disposed at a distal, interior-facing portion of the clamp arm 138. The gripping portion 140 may be modular or integral and is provided for increased resistance to the wear and tear associated with repeated lifting of rail. The clamp device 132 may be coupled to the clamp frame assembly 142 through a hydraulic cylinder 144, which is connected to the casing 134, for example via a pinned connection, to provide rotation of the clamp device 132.

When an obstacle, such as the joint bar 126, is detected and/or encountered, the transit clamp device 132 may be actuated to lift the rail 12 by lowering the clamp arm 138 via extension of the hydraulic cylinder 136 located internally of the casing 134. The transit clamp 132 may be further translated inwardly towards the clamp assembly frame 142 via the connecting hydraulic cylinder 144. Such translation may be performed simultaneously or sequentially with downward movement of the clamp arm 138. Of course, other embodiments are contemplated in which the clamp arm 138 is designed to pivot such that the clamp arm 138 rotates into position beneath the rail.

Figure 6:
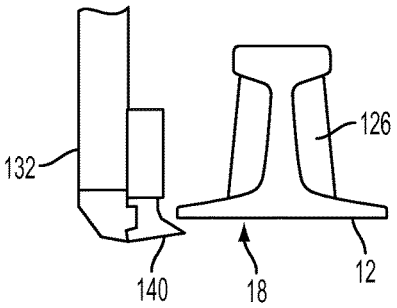
FIG. 6 is a cross-sectional view of an exemplary transit clamp and rail.

Referring to FIG. 6, once the transit clamp 132 is in place with the gripping portion 140 of the clamp arm 138 positioned beneath the rail 12 (i.e., beneath the foot 18 of the rail 12), the clamp assembly 114 may be lifted to thereby lift or "jack" the rail. In one embodiment, such lifting is accomplished with a pair of hydraulic cylinders 128 operatively coupled to the frame 104 of the rail vehicle 100. The lifting cylinders 128 act to lift the clamp assembly frame 142, and therefore the rail 12 via the transit clamp 132.

Additional lining operations may also be performed during jacking of the rail 12. As such, the additional pair of hydraulic cylinders 128 may be employed to impart lateral movement of the rail 12 in lining operations. In practice, the hydraulic cylinders 128 for lining may impart a lateral force on a lining arm, which is coupled to the clamp assembly frame 142 holding the rail 12 in a lifted position.

Figure 7A:
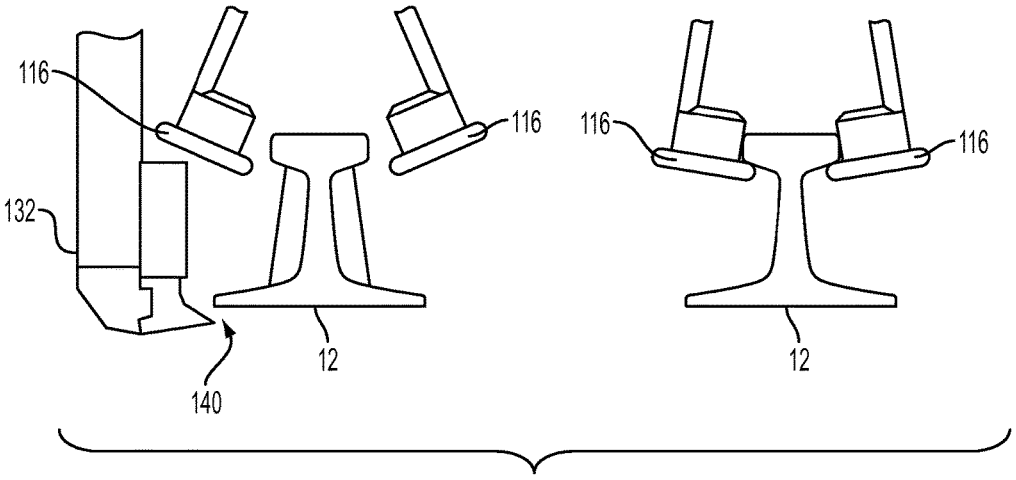
FIG. 7A is a cross-sectional view of exemplary transit clamps, roller clamps and rails.
Figure 7B:
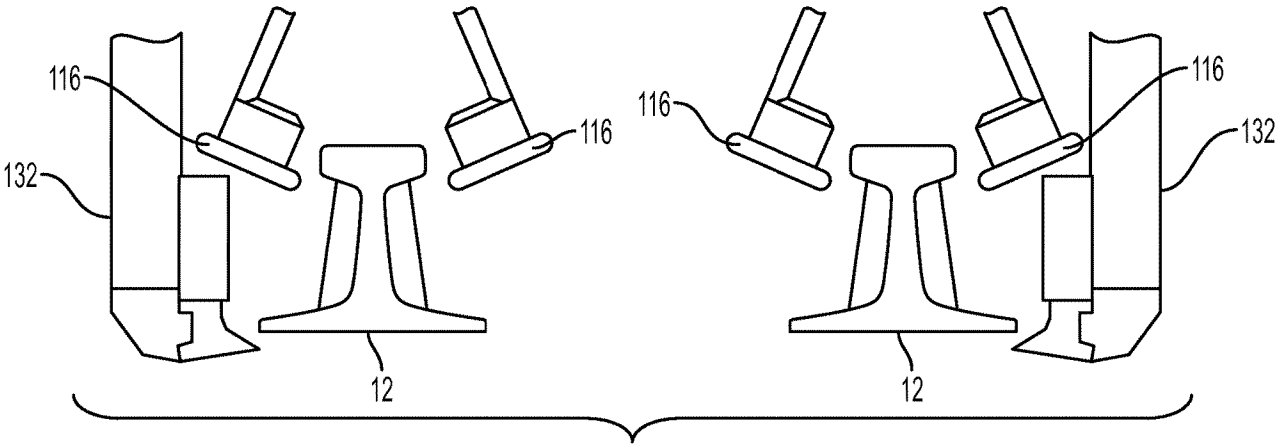
FIG. 7B is a cross-sectional view of exemplary transit clamps, roller clamps and rails.
Figure 7C:
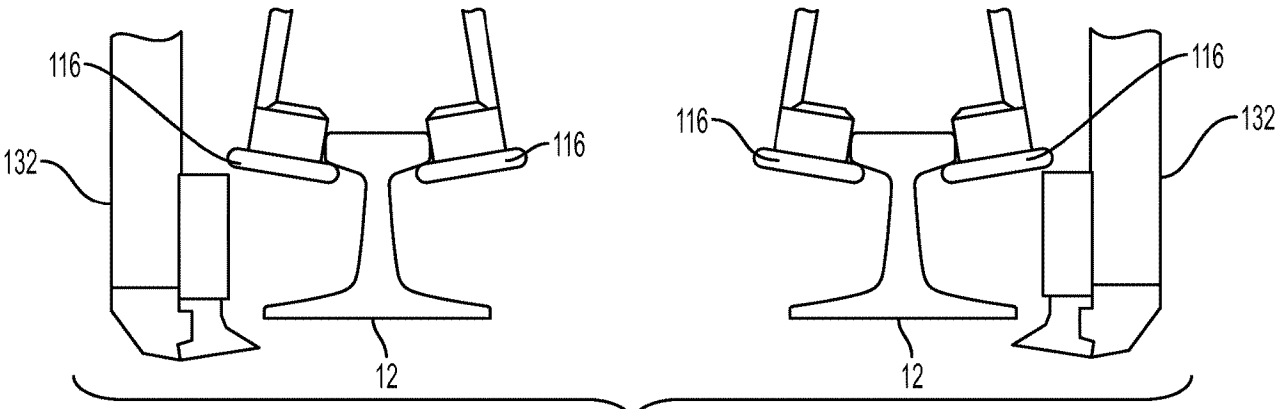
FIG. 7C is a cross-sectional view of exemplary transit clamps, roller clamps and rails.

It will be appreciated that the transit clamps 132 may be used independently or together also independent from or along with the roller clamps 116. For example, as shown in FIG. 7A, one rail may be engaged by one of the transit clamps 132 with another rail may be engaged by the roller clamps 116. As another example, as shown in FIG. 7B, two rails may be engaged by the transit clamps 132 without the roller clamps 116 engaged. As still another example, as shown in FIG. 7C, two rails may be engaged by the transit clamps 132 with the roller clamps 116 also engaged.

Figure 8:
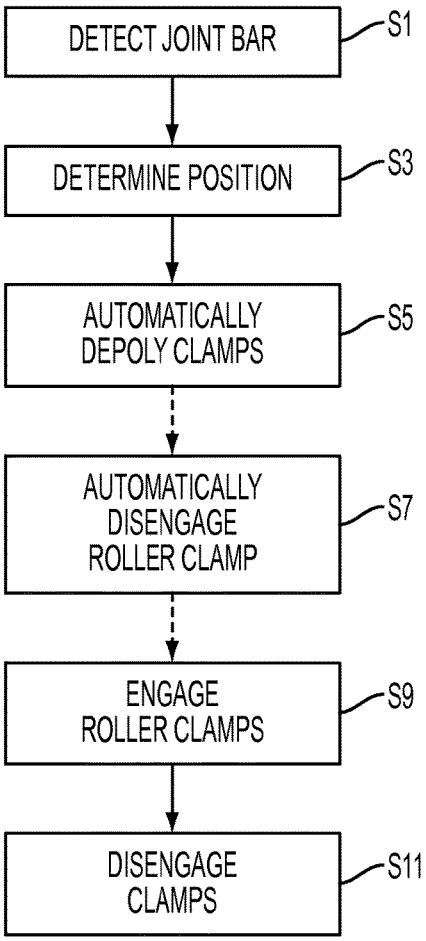
FIG. 8 is a flow chart of an exemplary operation of a transit clamp.

Referring now to FIG. 8, an exemplary operation of a rail maintenance vehicle is described. At step S1, a joint bar is detected, for example by a joint bar locator or tie locator disposed at a forward side of the rail maintenance vehicle. At step S3, the position of the joint bar is determined and it is determined when a work head assembly will reach the joint bar. The determination may be made by a processor disposed on or with the rail maintenance vehicle that takes into account information such as the distance between the joint bar locator and the work head assembly as well as a travelling speed of the rail maintenance vehicle, which may be obtained, for example, by an encoder coupled to a wheel that engages the rail. At step S5, the transit clamp is automatically engaged when, or just prior to, the work head assembly reaching the joint bar. Optionally, a roller clamp assembly may be disengaged at the same time as or slightly after the transit clamp is automatically engaged. After the work head assembly passes the joint bar, the roller clamp assembly may be engaged at step S9 if it was disengaged at step S9. The transit clamp is then disengaged at step S11.

The described process may be executed by a controller, a special purpose processor/computer or a general purpose processor programmed to execute the process. The process may also be in the form of computer executable instructions that, when executed by a processor, cause the processor to execute the correction process. The computer executable instructions may be stored on one or more computer readable mediums in whole or in parts. The instructions and/or the processor programmed to execute the process may be provided onboard the vehicle, which may be an autonomous vehicle, in a device external to the vehicle (for example, on an operator control interface or another piece of work equipment) that is in communication with the vehicle, or a combination thereof.

Figure 9:
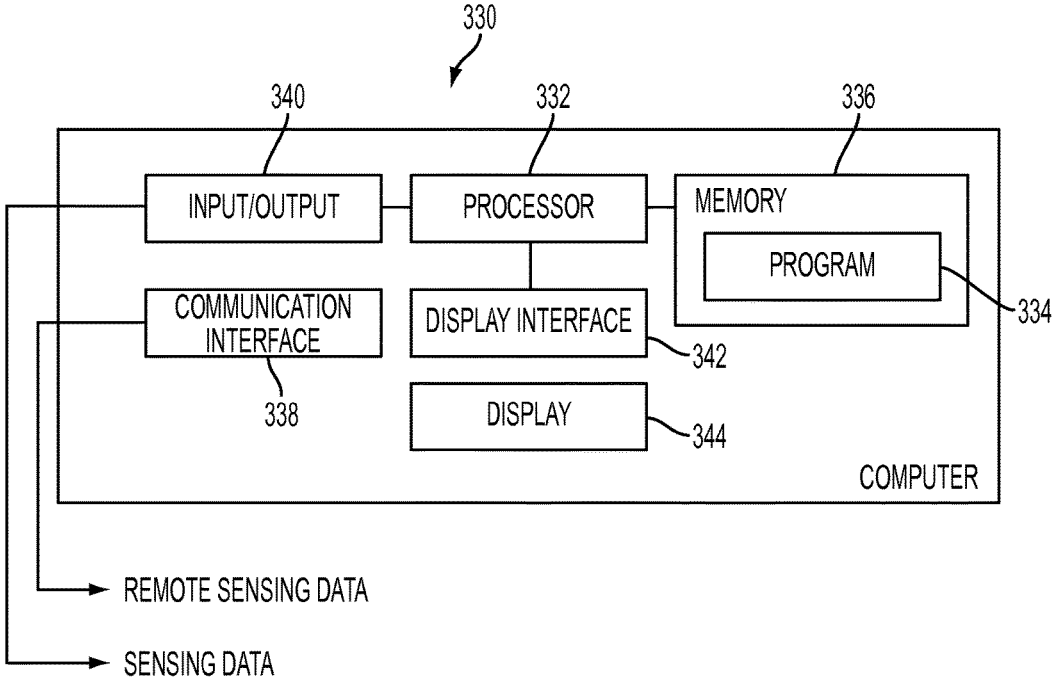
FIG. 9 is a block diagram an exemplary data processing system for carrying out rail maintenance processes.

For example, referring to FIG. 9, some embodiments of a computer or data processing system 300 may include a processor 332 configured to execute at least one program 334 stored in a memory 336 for the purposes of processing data to perform one or more of the techniques that are described herein. The processor 332 may be coupled to a communication interface 338 to receive remote sensing data. The processor 332 may also receive the sensing data via an input/output block 340. In addition to storing instructions for the program, the memory 336 may store preliminary, intermediate and final datasets involved in the techniques that are described herein. Among its other features, the computer or data processing system 300 may include a display interface 342 and a display 344 that displays the various data that is generated as described herein. It will be appreciated that the computer or data processing system 300 shown in FIG. 9 is merely exemplary (for example, the display may be separate from the computer, omitted, etc) in nature and is not limiting of the systems and methods described herein.

While various embodiments in accordance with the disclosed principles have been described above, it should be understood that they have been presented by way of example only, and are not limiting. For example, while the preferred embodiments describe use of the rail clamp of the present disclosure with a continuous action drone tamper vehicle, it is to be appreciated that the rail clamp may be incorporated into other types of tamper vehicles and other types of rail vehicles generally. Also, while hydraulic cylinders are described as the preferred actuation mechanisms for actuating the transit clamp, other types of actuation mechanisms are contemplated as falling within the scope of the present disclosure. Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically and by way of example, a description of a technology in the "Background" is not to be construed as an admission that technology is prior art to any invention(s) in this disclosure. Neither is the "Summary" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

The invention claimed is:

1. A rail vehicle, comprising:

a frame;

a pair of wheels that travel along a rail;

a joint locator that detects a joint bar on the rail;

a clamping assembly coupled to the frame, the clamping assembly including a pair of rail clamps disposed laterally outward of the pair of wheels, and the clamping assembly being operable to extend the rail clamps below a foot of the rail; and a processor configured to automatically actuate the clamping assembly to position the rail clamps beneath the rail and lift the rail when the clamping assembly reaches the joint bar.

2. The rail vehicle of claim 1, further comprising an actuator disposed between the clamping assembly and the frame, wherein actuation of the actuator provides a lifting force to the rail.

3. The rail vehicle of claim 2, wherein the actuator is a hydraulic actuator.

4. The rail vehicle of claim 2, further comprising a second actuator disposed between the clamping assembly and the frame, wherein actuation of the second actuator provides an inwardly or outwardly rotating force.

5. The rail vehicle of claim 1, wherein the clamping assembly includes a pair of extendable clamp arms respectively disposed between the clamps and the frame.

6. The rail vehicle of claim 5, wherein each of the clamp arms includes a protrusion extending towards the pair of wheels.

7. The rail vehicle of claim 6, wherein the clamp arms extend such that the protrusion is disposed below the rail upon which the wheels travel.

8. The rail vehicle of claim 6, therein the protrusions are removable from the clamp arms.

9. The rail vehicle of claim 6, wherein the protrusion includes a carbide portion.

10. The rail vehicle of claim 1, wherein the clamping assembly includes a roller clamp.

11. The rail vehicle of claim 10, wherein the pair of clamps are independently operable from the roller clamp.

12. The rail vehicle of claim 1, further comprising a work head assembly coupled to the frame.

13. The rail vehicle of claim 12, further comprising:

a sub-frame coupled to the frame, wherein the sub-frame reciprocates with respect to the frame, and the clamping assembly and work head assembly are coupled to the sub-frame.

14. The rail vehicle of claim 12, wherein the work head assembly includes a tamper work head.

15. The rail vehicle of claim 10, wherein the roller clamp is operable to grip an upper portion of the rail.

16. The rail vehicle of claim 1, wherein the clamping assembly is operable to engage the joint bar.

* * * * *